US009808823B2

(12) United States Patent
Pagendarm et al.

(10) Patent No.: US 9,808,823 B2
(45) Date of Patent: Nov. 7, 2017

(54) DEVICE FOR APPLYING A FREE-FLOWING MEDIUM TO A WEB

(75) Inventors: Ralph Pagendarm, Hamburg (DE); Peter Rose, Neuendorf-Sachsenbande (DE)

(73) Assignee: OLBRICH GMBH, Bocholt (DE)

( * ) Notice: Subject to any disclaimer, the term of this patent is extended or adjusted under 35 U.S.C. 154(b) by 668 days.

(21) Appl. No.: 13/881,793

(22) PCT Filed: Oct. 6, 2011

(86) PCT No.: PCT/EP2011/067430

§ 371 (c)(1),
(2), (4) Date: May 20, 2013

(87) PCT Pub. No.: WO2012/055686

PCT Pub. Date: May 3, 2012

(65) Prior Publication Data

US 2013/0233243 A1 Sep. 12, 2013

(30) Foreign Application Priority Data

Oct. 26, 2010 (DE) ..... 10 2010 049 387

(51) Int. Cl.
*B05C 1/08* (2006.01)
*B05C 11/04* (2006.01)

(52) U.S. Cl.
CPC ..... *B05C 1/0813* (2013.01); *B05C 1/0817* (2013.01); *B05C 11/041* (2013.01); (Continued)

(58) Field of Classification Search
CPC ... B05C 1/0817; B05C 1/0813; B05C 11/041; B05C 11/042; B05C 11/044; B05C 11/045; B05C 11/048; B41F 31/027
(Continued)

(56) References Cited

U.S. PATENT DOCUMENTS 4,309,960 A * 1/1982 Waldvogel ..... 118/665
5,226,364 A * 7/1993 Fadner ..... 101/366
(Continued)

FOREIGN PATENT DOCUMENTS

DE 102006017365 X 10/2007
EP 1117488 5/2004
(Continued)

*Primary Examiner* — Laura Edwards
(74) *Attorney, Agent, or Firm* — Lucas & Mercanti, LLP; Klaus P. Stoffel

(57) ABSTRACT

A device for applying a free-flowing medium to a continuously conveyed web, wherein the medium can be transferred to the web by a continuously rotating transfer (gravure) roll. An application head is provided in order to transfer the free-flowing medium to the circumference of the gravure roll. The application head includes a chamber which is open toward the circumference of the gravure roll and has an inlet and an outlet for the medium to be applied. The front outer face, in the direction of rotation, of the chamber is delimited by a front doctor blade and the rear outer face, in the direction of rotation, is delimited by a rear doctor blade. Both doctor blades are seated against the circumference of the gravure roll. The front doctor blade can be pressed against the circumference of the gravure roll by a pressing body with an adjustable pressing force.

4 Claims, 2 Drawing Sheets

(52) U.S. Cl.
CPC ..... *B05C 11/048* (2013.01); *B05C 11/042* (2013.01); *B05C 11/044* (2013.01); *B05C 11/045* (2013.01)

(58) Field of Classification Search
USPC ..... 118/413, 261; 101/363, 364
See application file for complete search history.

(56) References Cited

U.S. PATENT DOCUMENTS

| | | | | |
|---|---|---|---|---|
| 5,286,526 | A * | 2/1994 | Rantanen et al. | 427/356 |
| 5,768,993 | A | 6/1998 | Stuart | |
| 6,554,900 | B1 | 4/2003 | Aydin et al. | |
| 8,028,496 | B2 | 10/2011 | Deckert et al. | |
| 2002/0023587 | A1 | 2/2002 | Burgard | |
| 2010/0101681 | A1* | 4/2010 | Kramer et al. | 141/98 |

FOREIGN PATENT DOCUMENTS

| | | |
|---|---|---|
| JP | H0170898 | 5/1989 |
| JP | H07213 | 1/1995 |

* cited by examiner

DEVICE FOR APPLYING A FREE-FLOWING MEDIUM TO A WEB

The present application is a 371 of International application PCT/EP2011/067430, filed Oct. 6, 2011, which claims priority of DE 10 2010 049 387.2, filed Oct. 26, 2010, the priority of these applications is hereby claimed and these applications are incorporated herein by reference.

BACKGROUND OF THE INVENTION

A device of this type is known from EP 1 117 488 B1; this device, however, comprises two chambers in the applicator head, which can be subjected to different pressures. The pressure $p_0$ prevails in a prechamber, whereas the pressure $p_1$ can be set to the desired value in the main chamber in that a sealing element is provided between the prechamber and the main chamber to separate the two chambers from each other. Toward the outside, each chamber if sealed off by a doctor blade, which presses against an associated gravure cylinder. In addition, both the main chamber and the prechamber are provided with an inlet for the free-flowing medium to be applied to the web.

SUMMARY OF THE INVENTION

The goal of the invention is to continue to develop the known device in such a way that it is simpler and therefore less expensive to manufacture.

A device for applying a free-flowing medium to a continuously transported web. The device includes a continuously rotating transfer roll formed as a gravure cylinder provided with gravure grooves on its circumference. An applicator head is provided to transfer the free-flowing medium to the circumference of the gravure cylinder, the applicator head having a chamber open toward the circumference of the gravure cylinder with an inlet and an outlet for the medium to be applied. A front doctor blade is arranged to bound an outer side of the chamber at a front with respect to a direction of rotation, and a rear doctor blade is arranged to bound the outer side of the chamber at a rear with respect to the direction of rotation. Both doctor blades rest with a sealing action on the circumference of the gravure cylinder. A pressing body is arranged to press the front doctor blade against the circumference of the gravure cylinder with an adjustable pressing force. The pressing body determines a width of a two-dimensional contact zone of the front doctor blade with the gravure cylinder.

The invention is now explained in detail on the basis of the drawings.

DETAILED DESCRIPTION OF THE INVENTION

Parts in the one figure which are the same as those in the other are always provided with the same reference numbers.

Figure 1:
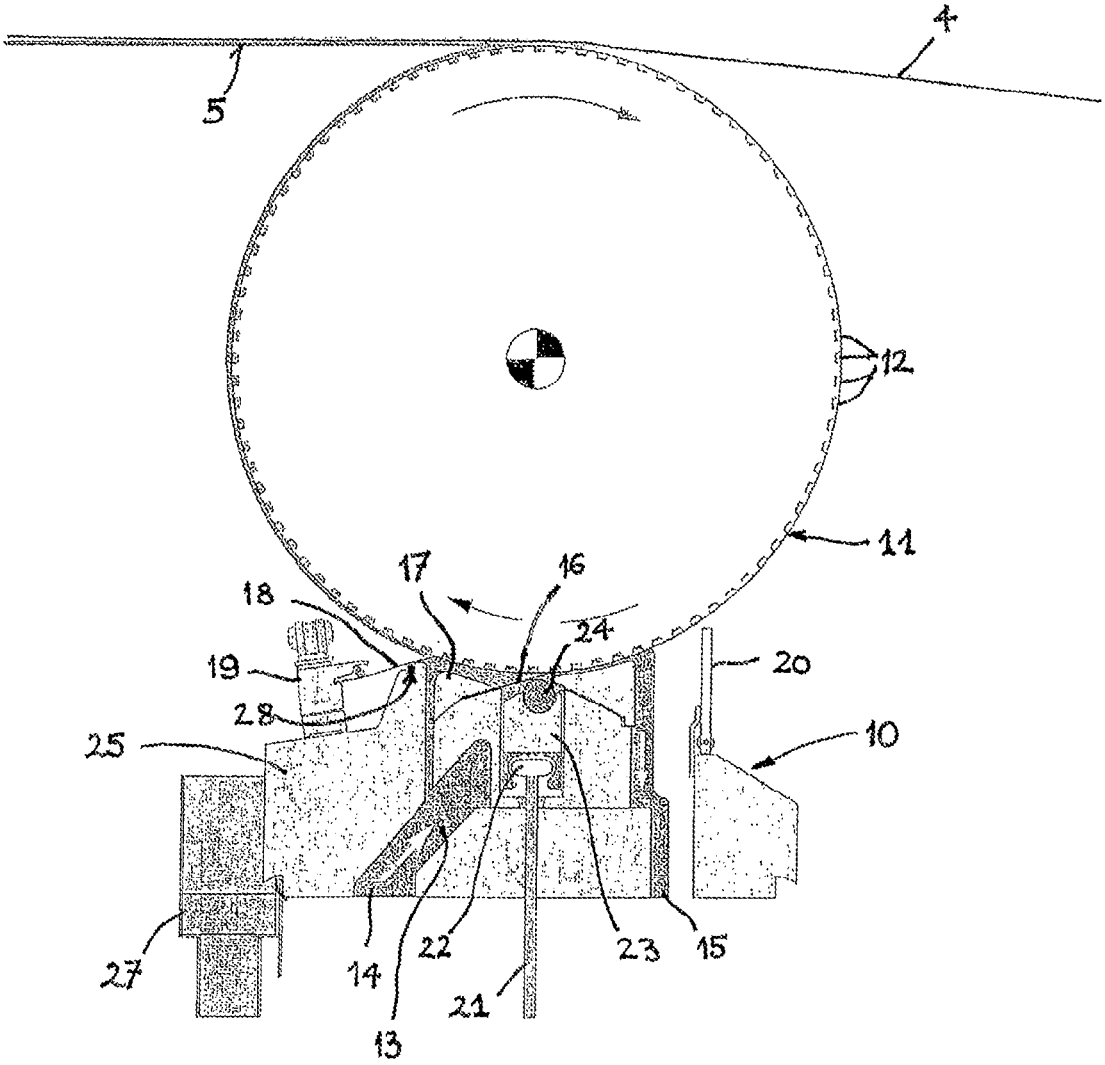
FIG. 1 shows a schematic diagram of the inventive device.

FIG. 1 shows a cross section through a gravure cylinder 11, which is provided with gravure grooves 12 on its circumference and which, when in operation, rotates in the clock-wise direction as indicated by the arrows. A web 4 to be coated passes over the top of the gravure cylinder 11; a free-flowing medium 5, which is supplied by an applicator head 10, is transferred from the gravure grooves 12 to the bottom surface of the web.

In the embodiment shown here, the applicator head 10 is underneath the gravure cylinder 11 and thus opposite the web 4. It extends in the manner of a beam down the entire length of the gravure cylinder 11, parallel to its generatrix, so that it can provide all of the gravure grooves 12 with the free-flowing medium 5 with which the web 4 is to be coated.

Figure 2A:
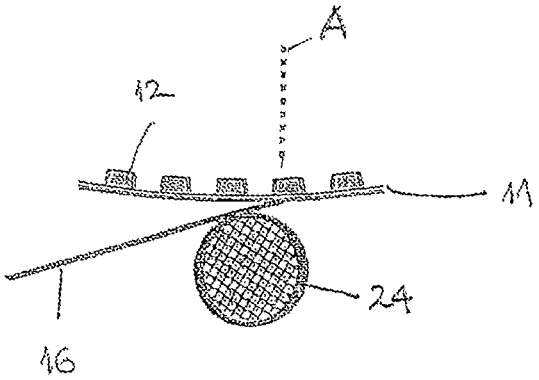
FIGS. 2*a*-2*c* show various degrees of pressure being exerted by a thrust piece used in the device according to FIG. 1.
Figure 2B:
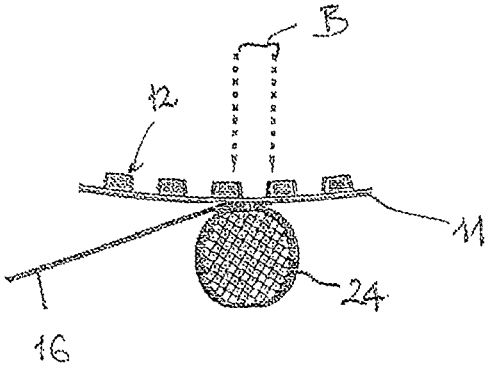
Figure 2C:
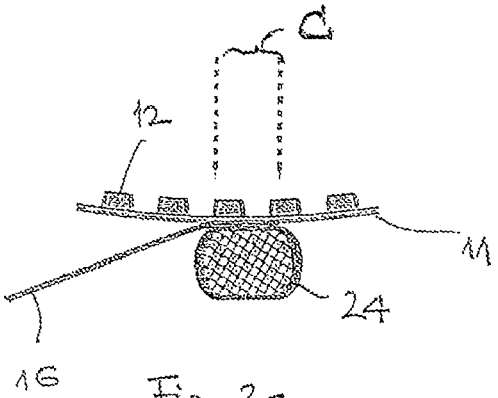

The applicator head 10 has a beam-like base body 25, to the left side of which a collecting tank 27 for the free-flowing medium 5 is attached, which will be discussed later in greater detail. On the side on the left with respect to the direction of rotation, the bottom surface of the applicator head 10 comprises an inlet 14 for a chamber 13, whereas, on the side of the applicator head 10 on the right with respect to the direction of rotation, an outlet 15 is provided in the bottom for the free-flowing medium 5 flowing through the chamber 13. Between the inlet 14 and the outlet 15, a compressed air line 21 extends upward into the applicator head 10 in the direction toward the gravure cylinder 11 and ends in a balloon 22, on top of which a movable thrust piece 23 is seated. The thrust piece 23 acts first on a compressible pressing body 24. The pressing body 24 consists of an elastic material, which is compressed in a definable manner by the inflation of the balloon 22, as shown in FIGS. 2*a*-2*c*.

It is to be pointed out that, instead of a compressed air line 21 with the balloon 22, some other design such as a plunger rod with plunger head or the like can be used to actuate the thrust piece 23.

On top of the pressing body 24 there lies a first or front doctor blade 16, which is held in place by a front doctor blade holder 17, mounted in the chamber 13. These types of designs are generally known to the person skilled in the art, so that there is no need to go into the details here. During operation, the front doctor blade 16 contacts the chamber 13 and seals it off on the front side in a defined manner.

In a similar manner, the rear of the chamber 13 is sealed off by a second or rear doctor blade 18, which is held in place by a rear doctor blade holder 19. The force which the rear doctor blade 18 exerts against the gravure cylinder 11 is formed by a rigid support 28 on the applicator head 10 in association with the rear doctor blade holder 19, the height of which can be adjusted, as can be seen in the drawing.

Not mentioned so far is a window 20, which is set up in removable fashion on the right side of the applicator head 10, so that the free outflow of the free-flowing medium 5 emerging from the chamber 13 can be observed, i.e., the medium which could no longer be taken up by the gravure grooves 12.

Finally, it should be pointed out that, depending on the width of the applicator head 10, it is possible to provide 1-5 inlets 14 to achieve a uniform pressure distribution, whereas a single outlet 15 is sufficient.

FIGS. 2*a*-2*c* now illustrate the essence of the invention, namely, the simplicity with which the pressure in the single chamber 13 can be adjusted to ensure that the gravure grooves 12 can be filled with the free-flowing medium 5 provided for the coating process without the presence of air bubbles.

In FIG. 2*a*, the pressing body 24 is not being compressed by the thrust piece 23, so that the front doctor blade 16 is merely resting on the pressing body 24, and there is only line contact between the blade and the gravure cylinder 11, as indicated by the broken line A. This is, so to speak, the "null" or starting position, which corresponds to a pressure $p_0$ in the chamber 13.

When the pressing body 24 is now compressed by the thrust piece 23, however, it presses the front doctor blade 16 more strongly against the gravure cylinder 11, and the line contact A of FIG. 2*a* now becomes two-dimensional contact as shown in FIG. 2*b*, wherein the broken lines B indicate the width of the two-dimensional contact zone. So that the free-flowing medium 5 can leave the chamber 13 under these conditions, the pressure in the chamber 13 must be increased from $p_0$ to $p_1$.

When the thrust piece 23 is actuated even more strongly, the pressing body 24 is compressed to an even greater degree, and the width of the two-dimensional contact zone is increased even more from B in FIG. 2*b* to C in FIG. 2*c*, which means that the pressure in chamber 13 must be increased to $p_2$ before any free-flowing medium can emerge from the outlet 15.

What is achieved by the pressure in the chamber 13 is that, depending on the width of the two-dimensional contact zone B or C, a larger or smaller amount of free-flowing medium 5 is forced to flow out from the chamber 13 at the rear doctor blade 18, because the rear doctor blade 18 makes only line contact with the gravure cylinder 11. This quantity of medium emerging from the chamber 13 at the rear with respect to the direction of rotation is distributed over the gravure grooves 12, while the remainder flows into the collecting tank 27.

LIST OF REFERENCE NUMBERS

4 web
5 free-flowing medium
10 applicator head
11 gravure cylinder
12 gravure grooves
13 chamber
14 inlet
15 outlet
16 front doctor blade
17 front doctor blade holder
18 rear doctor blade
19 rear doctor blade holder
20 window
21 compressed air line
22 balloon
23 thrust piece
24 pressing body
25 base body
27 collecting tank
28 support

The invention claimed is:

1. A device for applying a free-flowing medium to a continuously transported web, comprising:

a continuously rotating transfer roll formed as a gravure cylinder provided with gravure grooves on its circumference;

an applicator head provided to transfer the free-flowing medium to the circumference of the gravure cylinder, the applicator head having a chamber open toward the circumference of the gravure cylinder with an inlet and an outlet for the medium to be applied;

a front doctor blade arranged to bound an outer side of the chamber at a front with respect to a direction of rotation;

a rear doctor blade arranged to bound the outer side of the chamber at a rear with respect to the direction of rotation, both doctor blades resting with a sealing action on the circumference of the gravure cylinder; and a pressing body arranged to press the front doctor blade against the circumference of the gravure cylinder with an adjustable pressing force so as to change pressure in the chamber and thereby influence an amount of the medium flowing past the rear doctor blade, wherein the pressing body determines a width of a two-dimensional contact zone of the front doctor blade with the gravure cylinder.

2. The device according to claim 1, wherein the front doctor blade makes only line contact with the gravure cylinder when the pressing body is in a starting position, which corresponds to a pressure in the chamber, and the pressure in the chamber is increasable by the pressing body, the front doctor blade making two-dimensional contact with the gravure cylinder in a two-dimensional contact zone.

3. The device according to claim 1, further comprising a balloon arranged to compress the pressing body via a thrust piece.

4. The device according to claim 3, wherein the balloon is inflatable through a compressed air line so that the balloon is moved against the thrust piece.

* * * * *